US005581428A

United States Patent [19]

Smith

[11] Patent Number: 5,581,428

[45] Date of Patent: Dec. 3, 1996

[54] MOUNTING CLIP WITH BACK-UP OVERVOLTAGE PROTECTION

[75] Inventor: Thomas J. Smith, Bay Shore, N.Y.

[73] Assignee: TII Industries, Inc., Copiague, N.Y.

[21] Appl. No.: 380,612

[22] Filed: Jan. 30, 1995

Related U.S. Application Data

[63] Continuation of Ser. No. 87,451, Jul. 9, 1993, abandoned.

[51] Int. Cl.[6] ..... H02H 1/00

[52] U.S. Cl. ..... 361/119; 361/129

[58] Field of Search ..... 361/118–120, 127–132; 337/28, 29, 30, 32, 33, 34

[56] References Cited

U.S. PATENT DOCUMENTS 4,502,087 1/1985 Huvet ..... 361/119

5,224,013 6/1993 Pagliuca ..... 361/119

5,282,109 1/1994 Smith ..... 361/119

*Primary Examiner*—Jeffrey A. Gaffin

*Assistant Examiner*—Ronald W. Leja

*Attorney, Agent, or Firm*—Martin Sachs

[57] ABSTRACT

A mounting clip with back-up overvoltage protection which is adapted to receive an overvoltage protection device has dielectric disposed between one terminal of the back-up overvoltage protection apparatus and the other terminal thereof is in electrically conducting contact with a terminal of the three terminal overvoltage protection device with a dielectric disposed between the grounding clip and two terminals of the overvoltage protection device; the mounting clip functioning as the second terminal of the back-up overvoltage protection apparatus.

7 Claims, 1 Drawing Sheet

MOUNTING CLIP WITH BACK-UP OVERVOLTAGE PROTECTION

The present application is a Continuation of application Ser. No. 08/087,451, filed Jul. 9, 1993, by the Applicant Thomas J. Smith, presently abandoned.

BACKGROUND OF THE INVENTION

1. Field of the Invention

The present invention relates to overvoltage surge arrestor assemblies for protecting telephone communication lines from overvoltage thereon, and more particularly, to a back-up surge arrestor assembly affixed to the mounting clip which is adapted to receive an overvoltage protection device.

2. Discussion of the Relevant Art

The most pertinent patent appears to be that to Huvet, U.S. Pat. No. 4,502,087, issued Feb. 26, 1985, which discloses a surge voltage assembly that includes a threaded tubular housing member coupled to a circuit ground and includes therein an axially aligned compression spring, metallic cage with extending resilient fingers, a solder pellet and a gas-filled tube having a primary arc gap and an insulator with secondary arc gap holes separating a pair of electrically conductive members which contact one terminal of the gas-filled tube and a metallic cage to hold these items. A two terminal gas tube is used herein and thus it would require two of these assemblies to provide the same function as the instant invention and an entirely different mechanical construction.

The patent to Pagliuca, U.S. Pat. No. 4,150,414, issued Apr. 17, 1979, discloses a short circuit clip with legs for resiliently engaging a line and ground electrode of a gas tube arrestor and includes an air gap device proximate the legs. The device also uses a non-metallic fusible element interposed between the clip legs and the associated arrestor electrode.

The patent to Masghati, et al, U.S. Pat. No. 5,029,302, issued on Jul. 2, 1991, discloses a fail-safe arrestor for electrical circuits that uses a gas filled tube to conduct an overvoltage and provides a clip to couple the circuit to a ground lead upon the melting, from continuous current flow, of an insulator interposed between an electrode and the ground lead. The insulator is a mesh with a plurality of passages allowing arcing between the electrode and clip at or above a predetermined voltage, thus the ground lead is supplied for a vented gas-filled tube. A pair of these units would be required to accomplish protection for both the ring and tip circuits connected to telephone communication lines and a different mechanical arrangement.

The patent to Baumbach, U.S. Pat. No. 4,314,304, issued on Feb. 2, 1982, discloses a gas-tube surge arrestor and utilizes a secondary or back-up protector should the gas tube fail. The secondary air gap is established by perforated plastic sheets which are interposed between a line terminal and a ground contact both of which are supported on an insulated base. The means for holding the gas tube and the back-up overvoltage protection device require a plurality of brackets which is different than that shown in the instant invention.

The instant invention overcomes the shortcomings found in the prior art by providing an assembly which is mounted upon the ground clip that is adapted to receive a gas filled tube or a solid state semi conductor overvoltage protection device having a configuration similar to the gas tube.

SUMMARY OF THE INVENTION

A miniature back-up overvoltage protection apparatus, according to the principles of the present invention, may be utilized on a ground clip suitable for receiving an overvoltage protection device having three terminals. The first and second terminals are connected to the tip and ring terminals of a communication line with the third terminal being connected to a ground of the telephone line system. A clip adapted to removably retain the overvoltage protection device has a first and a second end portion. The first and second end portions of the clip have a first and a second back-up overvoltage protection apparatus affixed thereon, with the clip urging one terminal of the first back-up overvoltage protection apparatus against the first terminal of the overvoltage protection device and one terminal of the second backup overvoltage protection apparatus against the second terminal of the overvoltage protection device. The clip makes electrical conducting contact with the third terminal of the overvoltage protection device and the one terminal of the first and the one terminal of the second back-up overvoltage protection apparatus. An insulator is disposed between one terminal of the first and the second back-up overvoltage protection apparatus and the first and the second end portions of the clip. The dielectric has a centrally disposed through aperture and a plurality of additional through apertures disposed proximate the edges of the dielectric. One terminal of the back-up overvoltage protection apparatus is provided with an elongated portion adapted to be received by the centrally disposed through aperture of the dielectric and extends through a clearance through aperture provided in the end portions of the clip. The dielectric has a generally centrally disposed through aperture adapted to receive the elongated portion of the one terminal of the back-up overvoltage protection apparatus with the distal end of the elongated portion extending beyond the insulator. A retaining device is adapted to be affixed upon the elongated portion of the one terminal of the back-up overvoltage protection apparatus proximate the distal end thereof.

An object of the present invention is to provide a miniature back-up overvoltage protection apparatus affixed on the mounting clip adapted to receive an overvoltage protection device.

Another object of the present invention is to provide a back-up overvoltage protection apparatus of the air gap type which may be readily adapted to include an overheating fail short mechanism.

Yet another object of the present invention is to provide an inexpensive, easily assembled overvoltage protection apparatus.

Still yet another object of the present invention is to provide a miniature back-up overvoltage protection apparatus which may be maintained when the overvoltage protection device is replaced in the field after it has been destroyed by an overvoltage or gas leakage.

The foregoing and other objects and advantages will appear from the description to follow. In the description reference is made to the accompanying drawing which forms a part hereof, and in which is shown by way of illustration is a specific embodiment in which the invention may be practiced. This embodiment will be described in sufficient detail to enable those skilled in the art to practice the invention, and it is to be understood that other embodiments may be utilized and that structural changes may be made without departing from the spirit and scope of the invention. The following detailed description is, therefore, not to be taken in a limiting sense, and the scope of the present invention is best defined by the appended claims. In order to make the invention more readily understandable like reference characters refer to like elements.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENTS

Figure 1:
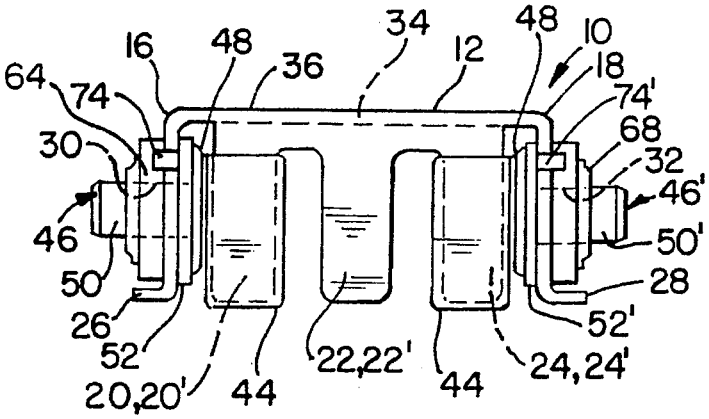
FIG. 1, is a side view in elevation of a back-up overvoltage protection apparatus, according to the principles of the present invention, mounted on a ground clip including temperature sensitive insulation.

Referring now to the figures, and in particular FIG. 1, there is shown a miniature back-up overvoltage protection apparatus 10, according to the principles of the present invention, for mounting on a grounding clip 12 which is adapted to receive a gas tube 14 (shown in FIG. 2) or an equivalently shaped solid state apparatus having the same mechanical configuration. The grounding clip 12 has affixed on both ends 16 and 18 the components of the protection apparatus 10, as will be described hereinafter. Hereinafter when reference is made to a gas tube it is to be understood that a solid state device having a similar mechanical configuration may be utilized in lieu thereof.

The ground clip 12 is provided with a plurality of fingers 20, 22 and 24, which are arcuate is shape and are adapted to receive the gas tube 14 therein. The ground clip 12 is also provided with a pair of end fingers 26 and 28 disposed on the end portions 16 and 18, respectively. End fingers 26 and 28 are provided with a generally centrally disposed through aperture 30 and 32, respectively. Grounding clip 12 is also provided with a through aperture 34 on the base portion 36 thereof suitable for receiving a rivet, or other mounting means, not shown, providing an electrically conductive path to a ground, not shown.

Figure 2:
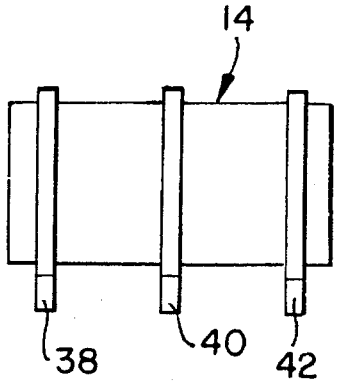
FIG. 2, is a side view in elevation of a gas tube surge arrestor device.

The overvoltage protection device 14, shown in FIG. 2, is provided with three electrically conducting terminals 38, 40 and 42 and when it is inserted into clip 12 terminal 40 of the gas tube 14 is in electrically conductive contact with finger 22 and thus connected to ground. The fingers 20 and 24 are covered with a temperature sensitive insulation so that terminals 38 and 42 are prevented from coming into electrically conductive contact with fingers 20 and 24, respectively. The insulation 44 may be constructed as a sleeve and inserted over the fingers 20 and 24 and 20' and 24' not shown. It is to be realized that fingers 20', 22' and 24' are not shown for convenience however, they are identical to fingers 20, 22 and 24 and complete the arcuate configuration of the fingers and are disposed directly behind the fingers 20, 22 and 24 as shown in FIG. 1. When reference is made to terminals 20, 22 and 24 it is to be understood that the terminals 20', 22' and 24' are functioning in the same manner and may be covered with a sleeve or a strip of the insulation 44. The temperature sensitive insulation 44 is preferably FEP manufactured by Dupont. Typically terminal 38 is connected to the tip terminal of the electrical communication system and terminal 42 of the gas tube 14 is connected to the ring terminal of the communication system.

Figure 3:
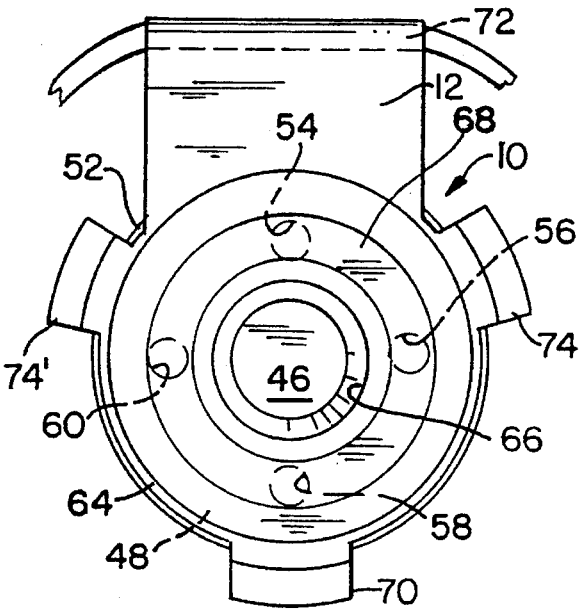
FIG. 3, is a greatly enlarged end view in elevation of the apparatus shown in FIG. 1.
Figure 4:
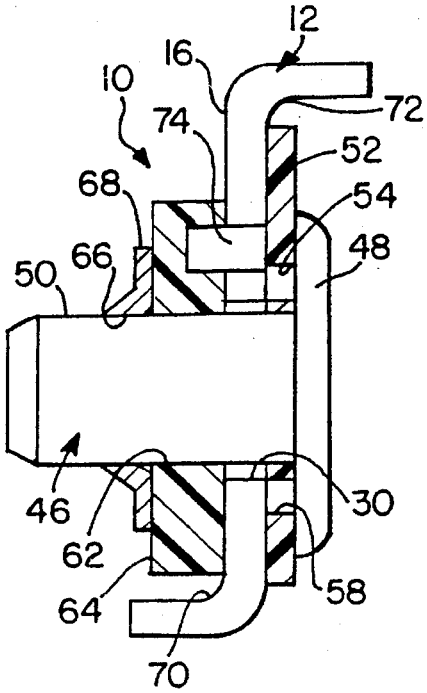
FIG. 4, is a greatly enlarged partial side view in cross section of the apparatus shown in FIG. 1.

Referring now to FIGS. 3 and 4, there is shown the end view of the apparatus shown in FIG. 1 and a cross-section of one end of the back-up overvoltage apparatus shown in FIG. 1. It is to be understood that the exact same configuration is utilized on the other end 18 of the grounding clip 12, which will be described hereinafter.

The back-up overvoltage apparatus 10, which is affixed to the grounding clip 12 includes a stud 46 that includes a flat head portion 48 and an elongated portion 50. The elongated portion 50 is sufficiently long to extend through the dielectric 52, preferably made of Kapton (a product of the DuPont Corporation of Delaware, U.S.A.), which is provided with a plurality of through apertures 54, 56, 58 and 60, the end portion 16 of grounding clip 12, through aperture 62, provided in the insulator 64 and an aperture 66 provided in a retaining ring 68. The positioning of the stud 46 is critical, since the elongated portion thereof must be centrally disposed in aperture 30 in order to provide the desired air gap which is the distance from the surface of the elongated portion 50 of stud 46 to the grounding end portion 16 of grounding clip 12. The diameter of insulator 64 and the thickness of dielectric 52 with the through apertures 54, 56, 58 and 60 provided therein provide an air gap path, via the stud 46 and grounding clip 12, which may occur between the elongated portion 50 of stud 46, as well as, the flat head portion 48 of stud 46 through the dielectric 52 or the through apertures 54, 56, 58 and 60 provided therein.

The diameters of the dielectric 52 and the insulator 64 are chosen so that they extend into the curved portions 70 and 72 and tab portions 74 and 74' of the grounding clip 12 so that their positioning may be readily controlled. The head portion 48 of stud 46 is in electrically conducting contact with terminal 38 of the gas tube 14 and the equivalent head portion 48' of stud 46' on the other end, is in electrically conductive contact with terminal 42 of the gas tube 14. A tab portion 74 and 74' is provided on the end portions 16 and 18 to help center the insulator 64.

In operation, the back-up overvoltage apparatus is installed in the clip 12 prior to the insertion of the gas tube 14 by positioning the dielectric 52 and the insulator 64. The stud 46 is inserted through the through apertures and retained in position by utilizing the retaining ring 68. The insulation means 44 is placed over the fingers 20, 20', 24, 24' prior to the insertion of the gas tube 14 within the arcuate fingers as described earlier.

Hereinbefore has been disclosed a miniature back-up surge protector apparatus, which may be affixed to the grounding clip adapted to receive a three terminal gas tube or solid state overvoltage device therein. The device may be preassembled prior to the insertion of the overvoltage protection device. The embodiment as disclosed herein includes the use of a non-metallic electrically insulating composition to be inserted beneath or over the fingers 20, 20', 24 and 24' to insulate the ground clip fingers from coming into electrically conductive contact with the terminals of the gas tube or solid state semiconductor device. Upon overheating this material provides a fail-safe ground for the end terminals, which will connect the tip and ring circuits of the telephone line system to ground. It will be understood that various changes in the details, materials, arrangement of parts, and operating conditions, which have been herein described and illustrated in order to explain the nature of the invention, may be made by those skilled in the art within the principles and scope of the instant invention.

Having thus set forth the nature of the invention, what is claimed is:

1. A miniature back-up overvoltage protection apparatus, comprising:

a) a mounting clip for removably retaining an overvoltage protection device, said mounting clip having a first and a second mounting clip end portion with a generally centrally disposed through aperture, said first and said second end portions having a first and a second back-up overvoltage protection apparatus, respectively, affixed thereon, said mounting clip adapted to urge one terminal of said first back-up overvoltage protection apparatus against a first terminal of an overvoltage protection device and one terminal of said second back-up overvoltage protection apparatus against the second terminal of the overvoltage protection device, and said mounting clip making electrically conductive contact with a third terminal of the overvoltage protection device, when an overvoltage protection device is disposed in said mounting clip;

b) dielectric means disposed between each said one terminal of said first and said second back-up overvoltage protection apparatus and said first and said second end portions of said clip, said dielectric means having a generally centrally disposed through aperture and a plurality of additional through apertures disposed proximate the edges of said dielectric means;

c) said one terminal of each said back-up overvoltage protection apparatus being provided with an elongated portion adapted to be received by said centrally disposed through aperture of said dielectric means and extend through said through aperture provided in each of the end portions of said clip;

d) insulation means having a generally centrally disposed through aperture adapted to receive each said elongated portion of said one terminal of said back-up overvoltage protection apparatus with the distal end of each said elongated portion extending beyond said insulation means; and e) retaining means adapted to be affixed upon each said elongated portion of said one terminal of said back-up overvoltage protection apparatus proximate the distal end thereof.

2. A miniature back-up overvoltage protection apparatus according to claim 1, wherein said dielectric means is provided with at least four through apertures.

3. A miniature back-up overvoltage protection apparatus according to claim 1, wherein said clip functions as the other terminal of said back-up overvoltage protection apparatus.

4. A miniature back-up overvoltage protection apparatus according to claim 1, wherein said insulation means is relatively thick relative to said dielectric means so that breakdown will occur in the air gaps provided by said dielectric through apertures.

5. A miniature back-up overvoltage protection apparatus according to claim 1, further including temperature sensitive insulation means disposed between said first terminal of said overvoltage protection device, said second terminal of said overvoltage protection device, and said clip to prevent shorting therebetween except when said insulation means melts upon exposure to excessive heat.

6. A miniature back-up overvoltage protection apparatus according to claim 1, further including a gas tube overvoltage protection device.

7. A miniature back-up overvoltage protection apparatus according to claim 1, further including a solid state overvoltage protection device.

* * * * *